US009363602B2

(12) United States Patent
Mentz

(10) Patent No.: US 9,363,602 B2
(45) Date of Patent: Jun. 7, 2016

(54) METHOD AND APPARATUS FOR PROVIDING VIRTUALIZED AUDIO FILES VIA HEADPHONES

(71) Applicant: James Mentz, Gainesville, FL (US)

(72) Inventor: James Mentz, Gainesville, FL (US)

(73) Assignee: BIT CAULDRON CORPORATION, Gainesville, FL (US)

( * ) Notice: Subject to any disclaimer, the term of this patent is extended or adjusted under 35 U.S.C. 154(b) by 371 days.

(21) Appl. No.: 13/735,854

(22) Filed: Jan. 7, 2013

(65) Prior Publication Data

US 2013/0177187 A1 Jul. 11, 2013

Related U.S. Application Data

(60) Provisional application No. 61/584,055, filed on Jan. 6, 2012.

(51) Int. Cl.
*H04R 5/02* (2006.01)
*H04R 5/033* (2006.01)
*H04S 7/00* (2006.01)

(52) U.S. Cl.
CPC ..... *H04R 5/033* (2013.01); *H04S 7/304* (2013.01); *H04R 2420/07* (2013.01)

(58) Field of Classification Search
CPC ..... H04S 1/005; H04S 2420/01
USPC ..... 381/310
See application file for complete search history.

(56) References Cited

U.S. PATENT DOCUMENTS

2006/0045294 A1* 3/2006 Smyth ..... H04S 7/304 381/309
2012/0128160 A1* 5/2012 Kim et al. ..... 381/17

OTHER PUBLICATIONS

Kuo, Y.S., et at., "Hijacking Power and Bandwidth From the Mobile Phone's Audio Interface," ACM DEV 2010, First Annual Symposium on Computing for Development, Dec. 17-18, 2010, London, pp. 1-10.

* cited by examiner

*Primary Examiner* — Simon King
(74) *Attorney, Agent, or Firm* — Saliwanchik, Lloyd & Eisenschenck

(57) ABSTRACT

Embodiments of the subject invention relate to a method and apparatus for providing virtualized audio files. Specific embodiments relate to a method and apparatus for providing virtualized audio files to a user via in-ear speakers or headphones. A specified embodiment can provide Surround Sound virtualization with DTS Surround Sensations software. Embodiments can utilize the 2-channel audio transmitted to the headphones. In order to accommodate for the user moving the headphones in one or more directions, and/or rotating the headphones, while still allowing the user to perceive the origin of the audio remains is a fixed location, heading data regarding the position of the headphones, the angular direction of the headphones, the movement of the headphones, and/or the rotation of the headphones can be returned from the headphones to a PC or other processing device. Additional processing of the audio files can be performed utilizing all or a portion of the received data to take into account the movement of the headphones.

16 Claims, 4 Drawing Sheets

METHOD AND APPARATUS FOR PROVIDING VIRTUALIZED AUDIO FILES VIA HEADPHONES

CROSS-REFERENCE TO RELATED APPLICATION

The present application claims the benefit of U.S. Provisional Application Ser. No. 61/584,055, filed Jan. 6, 2012, which is hereby incorporated by reference herein in its entirety, including any figures, tables, or drawings.

BACKGROUND OF INVENTION

Music is typically recorded for presentation in a concert hall, with the speakers away from the listeners and the artists. Many people now listen to music with in-ear speakers or headphones. The music recorded for presentation in a concert hall, when presented to users via in-ear speakers or headphones, often sounds like the music originates inside the user's head.

Providing virtualized audio files to a headphone user can allow the user to experience the localization of certain sounds, such as 3D sound, over a pair of headphones. Such virtualization can be based on head related transfer function (HRTF) technology or other audio processing that results in the user perceiving sounds originating from two or more locations in space, and preferably from a wide range of positions in space.

BRIEF SUMMARY

Embodiments of the subject invention relate to a method and apparatus for providing virtualized audio files. Specific embodiments relate to a method and apparatus for providing virtualized audio files to a user via in-ear speakers or headphones. A specified embodiment can provide Surround Sound virtualization with DTS Surround Sensations software. Embodiments can utilize the 2-channel audio transmitted to the headphones. In order to accommodate for the user moving the headphones in one or more directions, and/or rotating the headphones, while still allowing the user to perceive the origin of the audio remains is a fixed location, heading data regarding the position of the headphones, the angular direction of the headphones, the movement of the headphones, and/or the rotation of the headphones can be returned from the headphones to a PC or other processing device. Additional processing of the audio files can be performed utilizing all or a portion of the received data to take into account the movement of the headphones.

BRIEF DESCRIPTION OF THE DRAWINGS

FIG. 2A shows a view from a right side of the user, FIG. 2B shows a view from in front of the user, and FIG. 2C shows a view from the top of the user.

DETAILED DESCRIPTION

Figure 1:
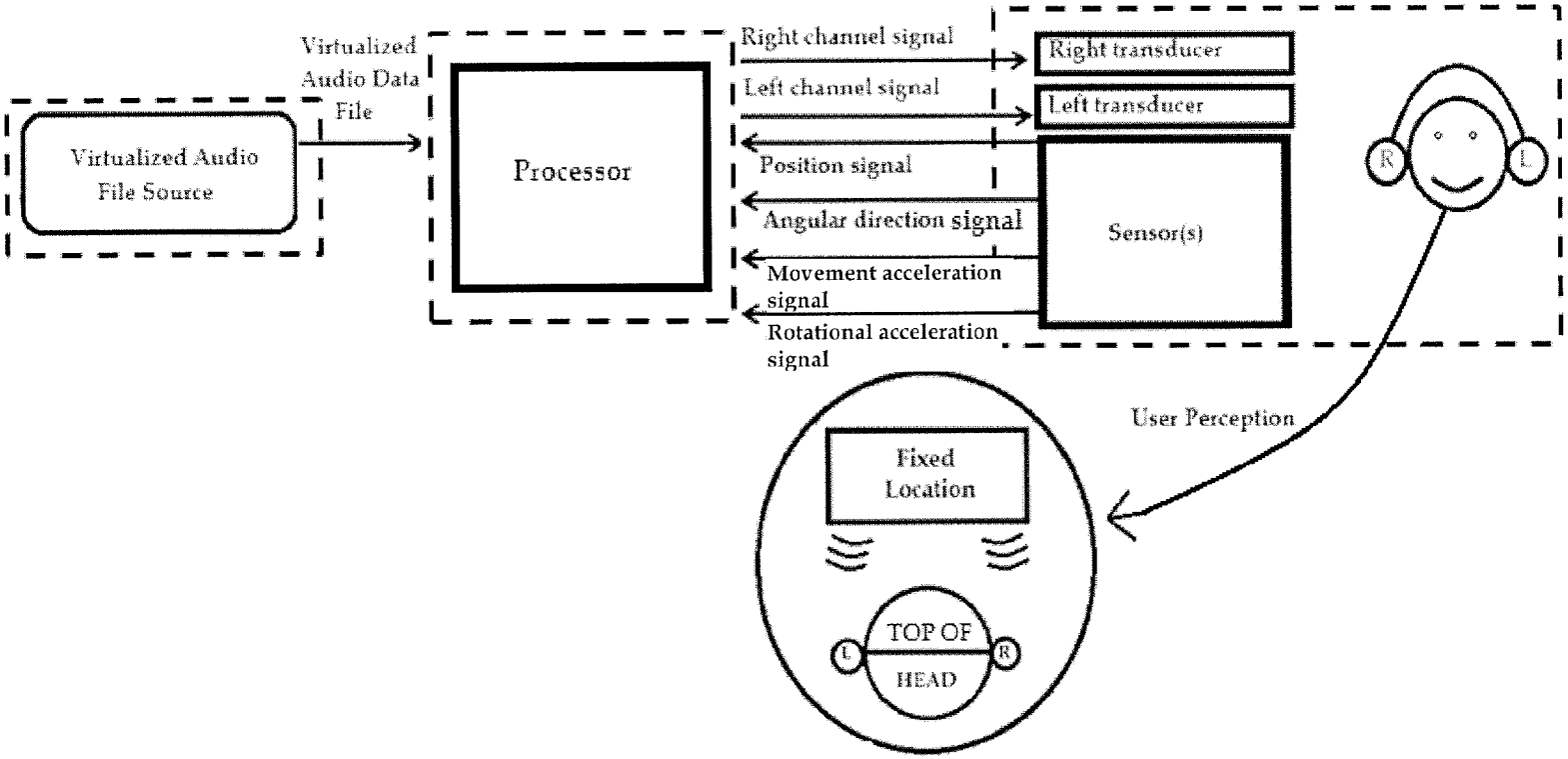
FIG. 1 shows a schematic of an apparatus for providing a virtualized audio file to a user in accordance with an embodiment of the invention.
Figure 2A:
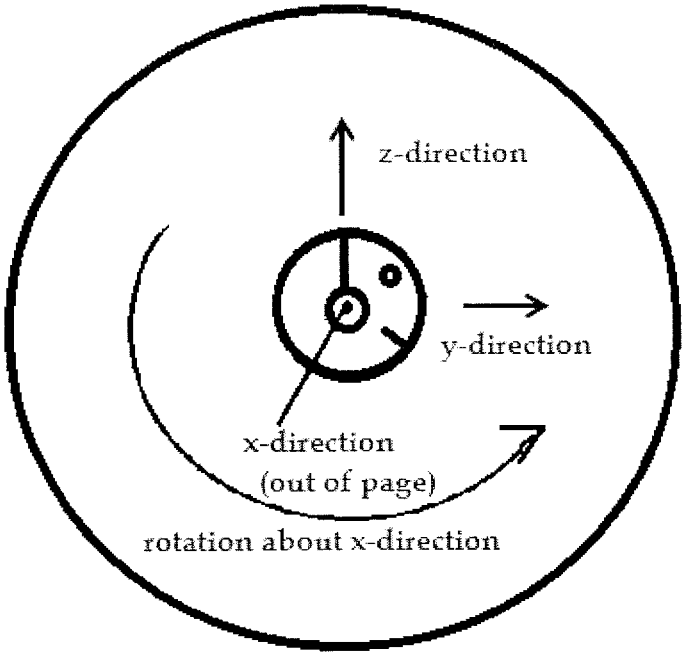
FIGS. 2A, 2B and 2C show views of a user wearing headphones from three different directions, indicating an x-axis, y-axis, and z-axis, where
Figure 2B:
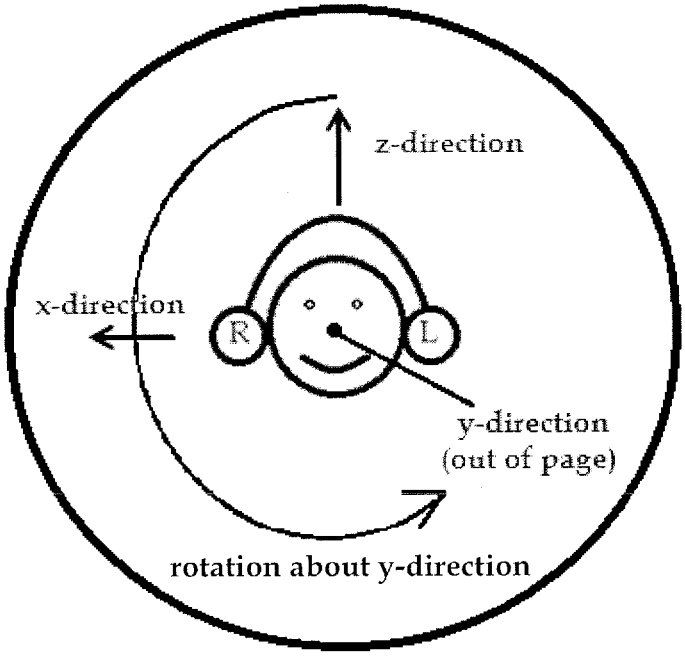
Figure 2C:
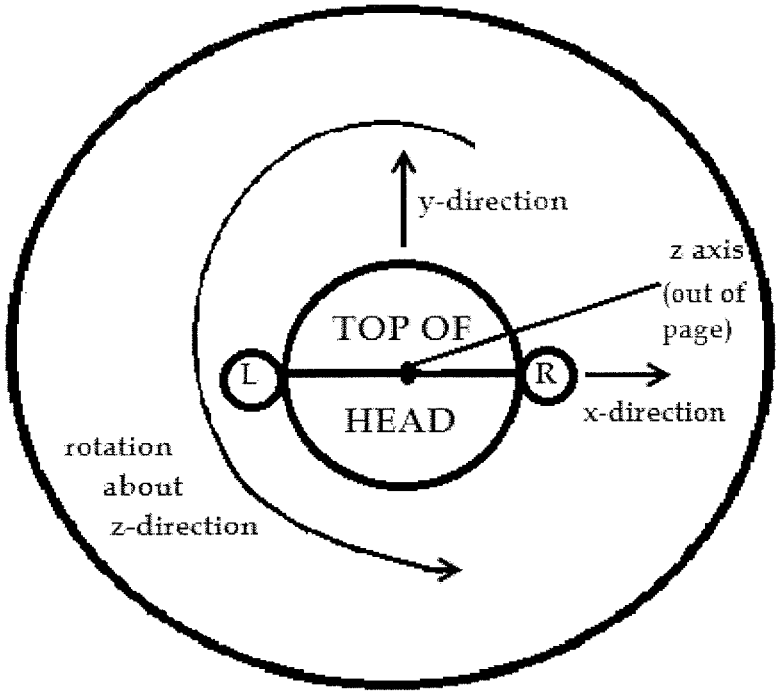
Figure 3:
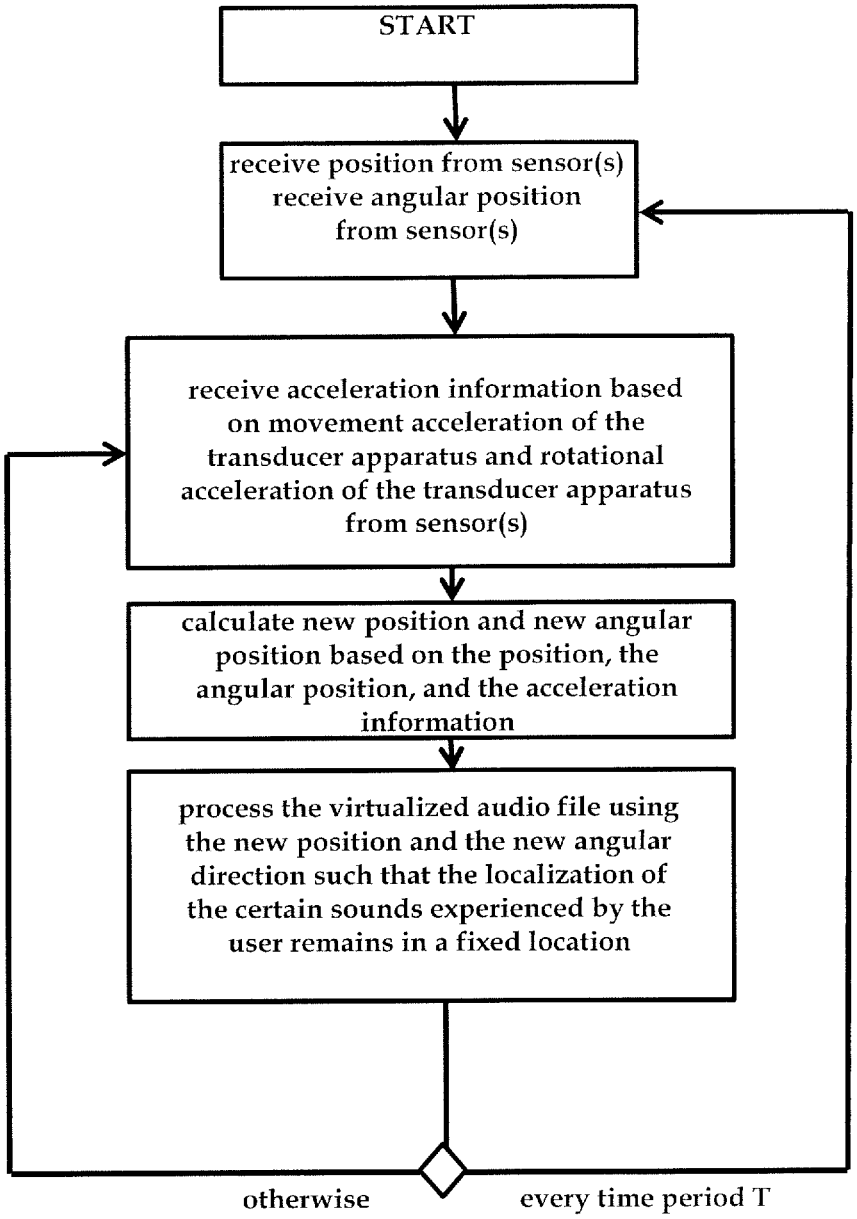
FIG. 3 shows a flowchart corresponding to a method for processing a virtualized audio file in accordance with an embodiment of the subject invention.

Embodiments of the subject invention relate to a method and apparatus for providing virtualized audio files. Specific embodiments relate to a method and apparatus for providing virtualized audio files to a user via in-ear speakers or headphones. A specified embodiment can provide Surround Sound virtualization with DTS Surround Sensations software. Embodiments can utilize the 2-channel audio transmitted to the headphones. In order to accommodate for the user moving the headphones in one or more directions, and/or rotating the headphones, while still allowing the user to perceive the origin of the audio remains is a fixed location, heading data regarding the position of the headphones, the angular direction of the headphones, the movement of the headphones, and/or the rotation of the headphones can be returned from the headphones to a PC or other processing device. Additional processing of the audio files can be performed utilizing all or a portion of the received data to take into account the movement of the headphones.

In specific embodiments, the data relating to movement and/or rotation of the headphones, which can be provided by, for example, one or more accelerometers, provides data that can be used to calculate the position and/or angular direction of the headphones. As an example, an initial position and heading of the headphones can be inputted along with acceleration data for the headphones, and then the new position can be calculated by double integrating the acceleration data to recalculate the position. However, errors in such calculations, meaning differences between the actual position and the calculated position of the headphones and differences between the actual angular direction and the calculated angular direction, can grow due to the nature of the calculations, e.g., double integration. The growing errors in the calculations can result in the calculated position and/or angular direction of the headphones being quite inaccurate. In specific embodiments, data relating to the position and/or heading (direction), for example position and/or angular direction, of the headphones can be used to recalibrate the calculated position and/or angular direction of the headphones for the purposes of continuing to predict the position and/or angular direction of the headphones. Such recalibration can occur at irregular intervals or at regular intervals, where the intervals can depend on, for example, the magnitude of the measured acceleration and/or the duration and/or type of accelerations. In an embodiment, recalibration of the position and/or the angular direction can be accomplished at least every 0.1 sec, at least every 0.01 sec, at least every 0.005 sec, at least every 0.004 sec, at least every 0.003 sec, at least every 0.002 sec, and/or at least every 0.001 sec, or at some other desired regular or variable interval. For this purpose, absolute heading data can be sent from the headphones, or other device with a known orientation with respect to the headphones, to a portion of the system that relays the heading data to the portion of the system processing the audio signals. Such angular direction data can include, for example, an angle a known axis of the headphones makes with respect to a reference angle in a first plane (e.g., a horizontal plane) and/or an angle the known axis of the headphone makes with respect to a second plane (e.g., a vertical plane).

Specific embodiments can also incorporate a microphone, and microphone support.

The headphones can receive the virtualized audio files via a cable or wirelessly (e.g., via RF or Bluetooth.

An embodiment can use a printed circuit board (PCB) to incorporate circuitry for measuring acceleration in one or more directions, position data, and/or heading (angular direction) data into the headphones, with the following interfaces: PCB fits inside wireless Bluetooth headphones; use existing audio drivers and add additional processing; mod-wire out to existing connectors; use existing battery; add heading sensors. In an embodiment, the circuitry incorporated with the headphones can receive the virtualized audio files providing a 3D effect based on a reference position of the headphones and the circuitry incorporated with the headphones can apply further processing to transform the signals based on the position, angular direction, and/or past acceleration of the headphones. Alternative embodiments can apply the transforming processing in circuitry not incorporated in the headphones.

In a specific embodiment, a Bluetooth Button and a Volume Up/Down Button can be used to implement the functions described in the table below:

| Bluetooth Button | Function |
|---|---|
| No user interaction required, this should always happen when device is on | Start or stop listening to music |
| Send answer or end a call signal or reconnect lost Bluetooth connection | 1 tap |
| Send redial signal | 2 taps |
| Activate pairing | Hold button until LED flashes Red/Blue (First power up: device starts in pairing mode) |
| Activate multipoint (optional for now - this allows the headphones to be paired with a primary and a secondary device) | Hold down the button while powering on |

| Volume Buttons | Function |
|---|---|
| Tap Volume Up/Down | Turn up/down volume and communicate volume up info to phone. As with a typical Bluetooth headset, volume setting should remain in sync between the headset and the phone. |
| Tap Volume Up while holding down the Bluetooth button [optional behavior] | Toggle surround mode between Movie Mode and Music Mode and send surround mode info back to phone. This setting should be nonvolatile. A Voice should say "Surround Sound Mode: Movie" or "Surround Sound Mode: Music." Note: this setting is overwritten by data from the phone or metadata in the content. Factory default is music. |
| Tap Volume Down while holding down the Bluetooth button [optional behavior] | Toggle virtualizer on/off. This is mostly for demo and could be reassigned for production. |

An embodiment can incorporate equalization, such as via a 5-Band equalization, for example, applied upstream in the player.

Preferably, embodiments use the same power circuit provided with the headphones. The power output can also preferably be about as much as an iPod, such as consistent with the description of iPod power output provided in various references, such as (Y. Kuo, et al., Hijacking Power and Bandwidth from the Mobile Phone's Audio Interface, Electrical Engineering and Computer Science Department, University of Michigan, Ann Arbor, Mich., 48109, <http://www.eecs.umich.edu/~prabal/pubs/papers/kuo10hijack.pdf>).

Embodiments can use as the source a PC performing the encoding and a headphone performing the decoding. The PC-based encoder can be added between a sample source and the emitter.

One or more of the following codecs are supported in various embodiments:

Bluetooth Stereo (SBC)

AAC and HE-AAC v2 in stereo and 5.1 channel

AAC+, AptX, and DTS Low Bit Rate

Heading information can be deduced from one or more accelerometers and a digital compass on the headphones and this information can then be available to the source.

A reference point and/or direction can be used to provide one or more references for the 3D effect with respect to the headphones. For example, the "front" of the sound stage can be used and can be determined by, for example, one or more of the following techniques:

1. Heading entry method. A compass heading number is entered into an app on the source. "Forward" is the vector parallel to the heading entry.
2. One-time calibration method. Each headphone user looks in the direction of their "forward" and a calibration button is pressed on the headphone or source.
3. Water World mode. In this mode all compass heading data is assumed to be useless and a calibration is the only data used for heading computation. The one-time calibration will drift and can be repeated frequently.

Various embodiments can incorporate a heading sensor. In a specific embodiment, the headphones can have a digital compass, accelerometer, and tilt sensor. From the tilt sensor and accelerometer, the rotation of the viewers forward facing direction through the plane of the horizon should be determined. In a specific embodiment, the tilt sensor data can be combined with the accelerometer sensor data to determine which components of each piece of rotation data are along the horizon.

This rotation data can then be provided to the source. The acceleration data provides high frequency information as to the heading of the listener (headphones). The digital compass (es) in the headphones and the heading sensor provide low frequency data, preferably a fixed reference, of the absolute angle of rotation in the plane of the horizon of the listener on the sound stage (e.g., with respect to front). This data can be referenced as degrees left or right of parallel to the heading sensor, from −180 to +180 degrees, as shown in the table below.

Which data is fused in the PC and which data is fused in the headphones can vary depending on the implementation goals. After the data is combined, the data can be made available via, for example, an application programming interface (API) to the virtualizer. Access to the output of the API can then be provided to the source, which can use the output from the API to get heading data as frequently as desired, such as every audio block or some other rate. The API is preferably non-blocking, so that data is available, for example, every millisecond, if needed.

| Heading information presented to API | Meaning |
|---|---|
| 0 [degrees] | Listener is facing same direction as heading sensor. Both are assumed to be in the center of the sound stage and looking toward the screen. |
| −1 to −179 [degrees] | Listener is facing to the left of the center of the sound stage. |
| 1 to 180 [degrees] | Listener is facing to the right of the center of the sound stage. |

Hysteresis, for example, around the −179 and +180 points can be handled by the virtualizer.

EMBODIMENTS

Embodiment 1

A method of providing a virtualized audio file to a user, comprising:

transmitting a virtualized audio file to a transducer apparatus worn by a user, wherein the transducer apparatus comprises at least one left transducer for converting a virtualized left channel signal into sound for presentation to a left ear of the user, wherein the transducer apparatus comprises at least one right transducer for converting a virtualized right channel signal into sound for presentation to a right ear of the user, wherein when the user listens to the sound from the at least one left transducer, and the at least one right transducer, via the left ear of the user, and the right ear of the user, respectively, the user experiences localization of certain sounds in the virtualized audio file;

capturing information regarding one or more of the following:

a position of the transducer apparatus, an angular direction of the transducer apparatus, movement of the transducer apparatus, and rotation of the transducer apparatus;

processing the virtualized audio file based on the captured information such that the localization of the certain sounds experienced by the user remains in a fixed location.

Embodiment 2

The method according to embodiment 1, wherein capturing information comprises capturing information regarding the position and the angular direction of the transducer apparatus.

Embodiment 3

The method according to embodiment 2, wherein capturing information comprises capturing information regarding movement acceleration and rotational acceleration of the transducer apparatus.

Embodiment 4

The method according to embodiment 3, wherein processing the virtualized audio file based on the captured information comprises:

inputting an initial position of the transducer apparatus and an initial angular direction of the transducer apparatus, inputting acceleration information based on movement acceleration and rotational acceleration of the transducer apparatus after the initial position and initial angular direction information are inputted;

calculating a new position and a new angular direction; and processing the virtualized audio file using the new position and the new angular direction such that the localization of the certain sounds experienced by the user remains in a fixed location.

Embodiment 5

The method according to embodiment 4, wherein the new position is calculated via double integrating the acceleration information.

Embodiment 6

The method according to embodiment 5, wherein the new angular direction is calculated via double integrating the acceleration information, wherein the acceleration data comprises angular acceleration data.

Embodiment 7

The method according to embodiment 1, wherein the transducer apparatus is a pair of in-ear speakers.

Embodiment 8

The method according to embodiment 1, wherein the transducer apparatus is a pair of headphones.

Embodiment 9

The method according to embodiment 4, further comprising:

recalibrating the new position and the new angular direction, wherein recalibrating the new position comprises replacing the new position with a measured position of the transducer apparatus, wherein the measured position is determined using the captured information regarding the position, wherein recalibrating the new angular direction comprises replacing the new angular direction with a measured angular direction, wherein the measured angular direction is determined using the captured information regarding the angular direction.

Embodiment 10

The method according to embodiment 9, wherein the measured angular direction is a measured angular direction of a device with a known orientation with respect to the transducer apparatus.

Embodiment 11

The method according to embodiment 9, where recalibrating the new position and the new angular direction is accomplished at least every 0.01 sec.

Embodiment 12

The method according to embodiment 9, where recalibrating the new position and the new angular direction is accomplished at least every 0.005 sec.

Embodiment 13

The method according to embodiment 9, where recalibrating the new position and the new angular direction is accomplished at least every 0.001 sec.

Embodiment 14

The method according to embodiment 9, wherein the measured angular direction is measured via a digital compass.

Embodiment 15

The method according to embodiment 8, wherein the measured angular direction comprises a first angle with respect to a first reference angle in a horizontal plane.

Embodiment 16

The method according to embodiment 13, wherein the measured angular direction comprises a second angle with respect to a second reference angle in a vertical plane.

Embodiment 17

The method according to embodiment 13, wherein the measured angular direction is measured via a heading sensor.

Embodiment 18

The method according to embodiment 8, wherein the measured angular direction is measured via a tilt sensor and at least one accelerometer.

Embodiment 19

The method according to embodiment 8, wherein the measured angular direction is provided in a number of degrees with respect to a fixed reference heading in a horizontal plane.

Embodiment 20

An apparatus for providing a virtualized audio file to a user, comprising:

A transmitter, wherein the transmitter transmits a virtualized audio file to a transducer apparatus worn by a user, wherein the transducer apparatus comprises at least one left transducer for converting a virtualized left channel signal into sound for presentation to a left ear of the user, wherein the transducer apparatus comprises at least one right transducer for converting a virtualized right channel signal into sound for presentation to a right ear of the user, wherein when the user listens to the sound from the at least one left transducer, and the at least one right transducer, via the left ear of the user, and the right ear of the user, respectively, the user experiences localization of certain sounds in the virtualized audio file;

one or more sensors, wherein the one or more sensors capture information regarding one or more of the following:

a position of the transducer apparatus, an angular direction of the transducer apparatus, movement of the transducer apparatus, and rotation of the transducer apparatus;

a processor, wherein the processor processes the virtualized audio file based on the captured information such that the localization of the certain sounds experienced by the user remains in a fixed location.

Aspects of the invention, such as receiving heading, position, and/or acceleration data, processing audio files in conjunction with such received data, and presenting sounds via headphones based on such processed audio files, may be described in the general context of computer-executable instructions, such as program modules, being executed by a computer. Generally, program modules include routines, programs, objects, components, data structures, etc., that perform particular tasks or implement particular abstract data types. Moreover, those skilled in the art will appreciate that the invention may be practiced with a variety of computer-system configurations, including multiprocessor systems, microprocessor-based or programmable-consumer electronics, minicomputers, mainframe computers, and the like. Any number of computer-systems and computer networks are acceptable for use with the present invention.

Specific hardware devices, programming languages, components, processes, protocols, and numerous details including operating environments and the like are set forth to provide a thorough understanding of the present invention. In other instances, structures, devices, and processes are shown in block-diagram form, rather than in detail, to avoid obscuring the present invention. But an ordinary-skilled artisan would understand that the present invention may be practiced without these specific details. Computer systems, servers, work stations, and other machines may be connected to one another across a communication medium including, for example, a network or networks.

As one skilled in the art will appreciate, embodiments of the present invention may be embodied as, among other things: a method, system, or computer-program product. Accordingly, the embodiments may take the form of a hardware embodiment, a software embodiment, or an embodiment combining software and hardware. In an embodiment, the present invention takes the form of a computer-program product that includes computer-useable instructions embodied on one or more computer-readable media.

Computer-readable media include both volatile and non-volatile media, transient and non-transient media, removable and nonremovable media, and contemplate media readable by a database, a switch, and various other network devices. By way of example, and not limitation, computer-readable media comprise media implemented in any method or technology for storing information. Examples of stored information include computer-useable instructions, data structures, program modules, and other data representations. Media examples include, but are not limited to, information-delivery media, RAM, ROM, EEPROM, flash memory or other memory technology, CD-ROM, digital versatile discs (DVD), holographic media or other optical disc storage, magnetic cassettes, magnetic tape, magnetic disk storage, and other magnetic storage devices. These technologies can store data momentarily, temporarily, or permanently.

The invention may be practiced in distributed-computing environments where tasks are performed by remote-processing devices that are linked through a communications network. In a distributed-computing environment, program modules may be located in both local and remote computer-storage media including memory storage devices. The computer-useable instructions form an interface to allow a computer to react according to a source of input. The instructions cooperate with other code segments to initiate a variety of tasks in response to data received in conjunction with the source of the received data.

The present invention may be practiced in a network environment such as a communications network. Such networks are widely used to connect various types of network elements, such as routers, servers, gateways, and so forth. Further, the invention may be practiced in a multi-network environment having various, connected public and/or private networks.

Communication between network elements may be wireless or wireline (wired). As will be appreciated by those skilled in the art, communication networks may take several different forms and may use several different communication protocols. And the present invention is not limited by the forms and communication protocols described herein.

All patents, patent applications, provisional applications, and publications referred to or cited herein are incorporated by reference in their entirety, including all figures and tables, to the extent they are not inconsistent with the explicit teachings of this specification.

It should be understood that the examples and embodiments described herein are for illustrative purposes only and that various modifications or changes in light thereof will be suggested to persons skilled in the art and are to be included within the spirit and purview of this application.

The invention claimed is:

1. A method of providing a virtualized audio file to a user, comprising:

transmitting a virtualized audio file to a transducer apparatus worn by a user, wherein the transducer apparatus comprises:

at least one left transducer for converting a virtualized left channel signal into sound for presentation to a left ear of the user; and at least one right transducer for converting a virtualized right channel signal into sound for presentation to a right ear of the user, wherein when the user listens to the sound from the at least one left transducer via the left ear of the user, and listens to the sound from the at least one right transducer via the right ear of the user, the user experiences localization of certain sounds in the virtualized audio file;

capturing information regarding one or more of the following:

a position of the transducer apparatus, an angular direction of the transducer apparatus, movement of the transducer apparatus, and rotation of the transducer apparatus; and processing the virtualized audio file based on the captured information to produce a processed virtualized audio file, such that when the virtualized left channel signal and the virtualized right channel signal based on the processed virtualized audio file are converted to sound and the user listens to the sound from the at least one left transducer via the left ear of the user, and listens to the sound from the at least one right transducer via the right ear of the user, the localization of the certain sounds experienced by the user remains in a fixed location, wherein capturing information comprises capturing information regarding the position of the transducer apparatus and information regarding the angular direction of the transducer apparatus, wherein capturing information comprises capturing information regarding movement acceleration of the transducer apparatus and information regarding rotational acceleration of the transducer apparatus, wherein processing the virtualized audio file based on the captured information comprises:

a. inputting captured information regarding the position of the transducer apparatus and captured information regarding the angular direction of the transducer apparatus;

b. inputting captured information regarding movement acceleration of the transducer apparatus and captured information regarding rotational acceleration of the transducer apparatus;

c. calculating a new position and a new angular direction based on the captured information regarding the position of the transducer apparatus, the captured information regarding the angular direction, the captured information regarding movement acceleration of the transducer apparatus, and the captured information regarding rotational acceleration of the transducer apparatus; and d. processing the virtualized audio file using the new position and the new angular direction to produce the processed virtualized audio file, such that when the virtualized left channel signal and the virtualized right channel signal based on the processed virtualized audio file are converted to sound and the user listens to the sound from the at least one left transducer via the left ear of the user, and listens to the sound from the at least one right transducer via the right ear of the user, the localization of the certain sounds experienced by the user remains in a fixed location.

2. The method according to claim 1, wherein the captured information regarding the position of the transducer apparatus comprises information regarding movement acceleration of the transducer apparatus, and wherein the new position is calculated via double integrating the movement acceleration of the transducer apparatus.

3. The method according to claim 2, wherein the captured information regarding the angular direction of the transducer apparatus comprises information regarding rotational acceleration of the transducer apparatus, and wherein the new angular direction is calculated via double integrating the rotational acceleration of the transducer apparatus.

4. The method according to claim 1, wherein the transducer apparatus is a pair of in-ear speakers.

5. The method according to claim 1, wherein the transducer apparatus is a pair of headphones.

6. The method according to claim 1, wherein the information regarding the angular direction of the transducer apparatus is a measured angular direction of a device with a known orientation with respect to the transducer apparatus.

7. The method according to claim 1, further comprising:

e. repeating b, c, and d over a time period T;

f. capturing additional information regarding the position of the transducer apparatus and additional information regarding the angular direction of the transducer apparatus; and g. recalibrating the new position and the new angular direction, wherein recalibrating the new position comprises replacing the new position with a measured position of the transducer apparatus, wherein the measured position is determined using the captured additional information regarding the position of the transducer apparatus, wherein recalibrating the new angular direction comprises replacing the new angular direction with a measured angular direction, and wherein the measured angular direction is determined using the captured additional information regarding the angular direction of the transducer apparatus.

8. The method according to claim 7, further comprising:

repeating e, f, and g every T2 seconds wherein T2 is less than or equal to 0.01.

9. The method according to claim 7, further comprising:

repeating e, f, and g every T2 seconds wherein T2 is less than or equal to 0.005.

10. The method according to claim 7, further comprising:

repeating e, f, and g every T2 seconds wherein T2 is less than or equal to 0.001.

11. The method according to claim 7, wherein the captured additional information regarding the angular direction of the transducer apparatus is a measured angular direction of the transducer apparatus, and wherein the measured angular direction of the transducer apparatus is measured via a digital compass.

12. The method according to claim 7,
wherein the measured angular direction of the transducer apparatus comprises a first angle with respect to a first reference angle in a horizontal plane.

13. The method according to claim 12,
wherein the measured angular direction comprises a second angle with respect to a second reference angle in a vertical plane.

14. The method according to claim 7,
wherein the captured additional information regarding the angular direction of the transducer apparatus is a measured angular direction of the transducer apparatus, and
wherein the measured angular direction of the transducer apparatus is measured via a heading sensor.

15. The method according to claim 7,
wherein the captured additional information regarding the angular direction of the transducer apparatus is a measured angular direction of the transducer apparatus, and
wherein the measured angular direction is measured via a tilt sensor and at least one accelerometer.

16. The method according to claim 7,
wherein the captured additional information regarding the angular direction of the transducer apparatus is a measured angular direction of the transducer apparatus, and
wherein the measured angular direction is provided in a number of degrees with respect to a fixed reference heading in a horizontal plane.

* * * * *